United States Patent [19]

Heineman

[11] Patent Number: 4,974,998

[45] Date of Patent: Dec. 4, 1990

[54] WEAR-RESISTANT CENTRIFUGAL SOLIDS PUMP LINING

[76] Inventor: Rolf Heineman, 3961 SW. Seymour Ct., Portland, Oreg. 97221

[21] Appl. No.: 312,811

[22] Filed: Feb. 21, 1989

[51] Int. Cl.[5] ..... B65G 53/58

[52] U.S. Cl. ..... 406/97; 406/193

[58] Field of Search ..... 406/97, 193, 99, 100

[56] References Cited

U.S. PATENT DOCUMENTS

| | | | |
|---|---|---|---|
| 1,233,115 | 7/1917 | Osborne | 406/97 |
| 1,806,494 | 5/1931 | O'Brien | 406/97 |
| 3,018,736 | 1/1962 | Clay | 406/99 |
| 4,564,319 | 1/1986 | Van Waveren | 406/193 |
| 4,595,318 | 6/1986 | Viesselmann | 406/97 |

*Primary Examiner*—Joseph F. Peters, Jr.
*Assistant Examiner*—Anne E. Bidwell
*Attorney, Agent, or Firm*—Olson & Olson

[57] ABSTRACT

An abrasion-resistant liner for centrifugal solids type pumps comprises a plurality of hard metal segments attached to the inner circumferential wall of a conventional pump in spaced apart condition thereabout. The open spaces thus formed between each adjacent hard metal liner segment receive a soft abrasion-resistant material such as rubber, synthetic thermoplastic resin, or other polymer or elastomer material, bonded, vulcanized or otherwise secured to the pump housing and to the hard liner segments, thereby forming a plurality of alternating liner segments of hard and soft material, together forming an even, smooth liner surface substantially encircling the impeller of the pump. In this manner, solids and sharp objects being pumped are deflected by the spaced apart metal segments, reducing damage of the abrasion-resistant material, while the meal segments also serve to more positively secure the soft abrasion-resistant material in bonded condition on the pump housing. Moreover, the provision of a liner formed of a plurality of alternating segments permits the easy and quick repair of damage to the liner surface by simple replacement of individual hard and soft segments, rather than the necessity of replacing an entire liner as is now common in the art.

7 Claims, 2 Drawing Sheets

WEAR-RESISTANT CENTRIFUGAL SOLIDS PUMP LINING

BACKGROUND OF THE INVENTION

This invention relates to centrifugal solids type pumps, and more particularly to an abrasion-resistant lining for the interior casings of such pumps.

The hydraulic transport of solids, for example sand, gravel, ore, coal and the like, through a pipeline is accomplished by means of diluting these solids with water, forming a slurry which is then pumped by means of a conventional centrifugal pump. Most of the machinery exposed to these slurries experience considerable wear through abrasion and impact. Dredge pumps for example are designed to pump large rocks and various other types of debris encountered in dredging, such as logs, chains, cables, scrap and the like.

The various kinds of slurry and dredge pumps are designed and manufactured to fit certain applications, and smaller pump casings, those up to 12 inches in discharge diameter, are often lined with an abrasion-resistant rubber compound which is vulcanized or otherwise bonded onto the structural or cast steel housing. Abrasion-resistant polymer linings, such as polyurethane, have also found application in slurry pump casings. These linings most often outlast steel or iron pump casings but they are also susceptible to failure due to bonding limitations to the steel. They have limited success in larger pumps, those pumps having a greater than 14 inch discharge diameter, and the higher impact of the solids onto these "soft" liners often cause bonding failure. Additionally, the larger size pumps allow larger objects to enter the pump and, especially in dredging, these objects are often sharp and cut or tear the "soft" lining, causing failure of the pump and the need for repair.

SUMMARY OF THE INVENTION

In its basic concept this invention provides an abrasion resistant liner for the interior circumferencial surface wall of a pump housing or casing, the liner comprising alternating sections of "hard" metal segments and "soft" rubber or the like segments attached to the pump housing encircling the impeller of the pump.

It is by virtue of the foregoing basic concept that the principal objective of this invention is achieved; namely, the provision of an abrasion-resistant liner for centrifugal solids pumps which overcomes the limitations and disadvantages of the prior art.

Another object of this invention is the provisions of a pump liner material of the class described which has the abrasion and impact resistance of rubber while also having a greatly improved bonding ability to the pump housing.

Another object of this invention is the provision of a pump liner of the class described which reduces the occurrence of cutting or tearing of the soft liner frequently occurring in conventional liners found in the art.

Still another object of this invention is the provision of the pump liner of the class described which provides a secure bonding area for the soft portions of the liner to prevent bonding failure.

A still further object of this invention is the provision of a pump liner of the calss described which increases the working life of a pump between normal servicings, thereby increasing the efficiency of such pumps while reducing "down time" caused by routine maintenance and repair, and thus provide a more economical overall operation of such pumps.

The foregoing and other objects and advantages of this invention will appear from the following detailed description, taken in connection with the accompanying drawings of a preferred embodiment.

DESCRIPTION OF THE PREFERRED EMBODIMENT

Figure 1:
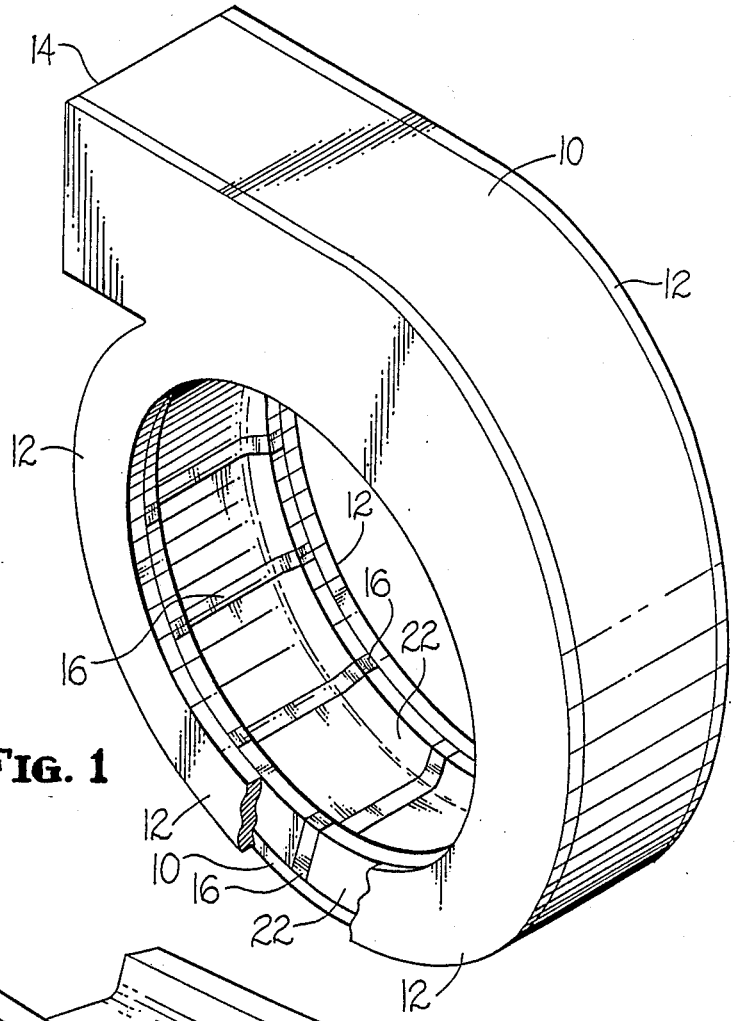
FIG. 1 is a perspective view of a pump housing typical of pumps known in the art, the housing mounting an abrasion resistant liner embodying the features of this invention, a part of the pump housing side wall being broken away to better expose the alternating liner sections of this invention.

The present invention provides an abrasion-resistant lining for the internal wall surface of a pump housing in pumps operated primarily in connection with uses in which pumped material contains solids that cause excessive wear, impact and abrasion as the material travels through the pump. The invention therefore provides a lining for the inside wall surface of a conventional pump housing, the lining receiving the impact and wear resulting from the pumping of solid materials therethrough, the segmented lining being much more easily and economically repairable and replacable than similar repairs to the pump housing itself or heretofore known liners.

The drawings illustrate a typical pump housing 10 absent its side cover plates, impeller, motor, fittings, etc.. Generally, pumps of these type are very large, but it is to be understood that the lining of this invention may as well find utility in smaller, conventional water pumps, trash pumps, sump and bilge type pumps and other known pumps as well.

As illustrated, the pump housing 10, or pumpshell, includes side walls 12, and side plates (not shown) which would normally cover and seal the pump sides and would mount the impeller and water inlet, as is normal. Other configurations of water pumps are known, and the lining of this invention is equally usable in the housings of those pumps as well. The water discharge outlet 14 shown is also regarded as a conventional construction.

The pumpshell is normally a structural casing which can withstand the internal pressures associated with the particular pump design. This structural casing may be fabricated from mild steel plate, or manufactured as a casting from mild steel or higher carbon steel alloys. In the provision of the abrasion-resistant lining of this invention, a plurality of projecting, hard metal rib members 16 are anchored in spaced apart condition circumferencially about the inner wall surface of the housing, as shown best in FIGS. 1, 2 and 3. These ribs may be secured on the housing wall by any suitable, conventional means, such as welds 18 shown in FIG. 2, or by bolts 20 as shown in FIG. 4.

Figure 2:
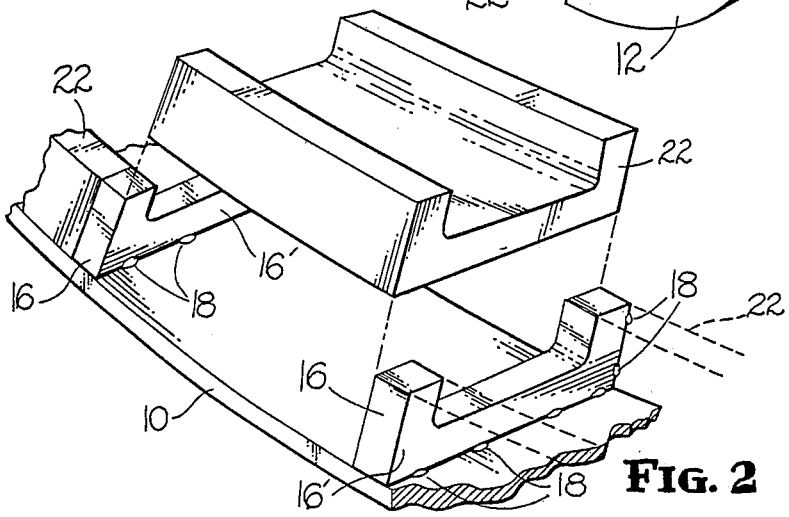
FIG. 2 is a fragmentary, exploded view of a portion of the liner of this invention, one section of "soft"abrasion resistant material disposed between adjacent, spaced apart "hard" ribs, one "soft" section being lifted out of installed position between adjacent ribs to better illustrate the alternating arrangement of liner sections.

The spaces formed between the ribs 16 are provided with "soft" abrasion resistant material 22 bonded to the inner housing wall 10, corresponding side walls 12, and to the confronting edge surface 16' of the ribs 16, as seen best in FIGS. 1 and 2. This "soft" material 22 preferably comprises rubber, synthetic thermoplastic resin, or other suitable polymer material having the desired abrasion-resistant qualities for the purpose, and is secured in place by vulcanizing into position, bonding with suitable cement, or anchoring by appropriate fastening means (not shown). The preferred method is by vulcanizing the material in place, although it is to be understood that the invention is not limited to any particular form of attachment.

Figure 3:
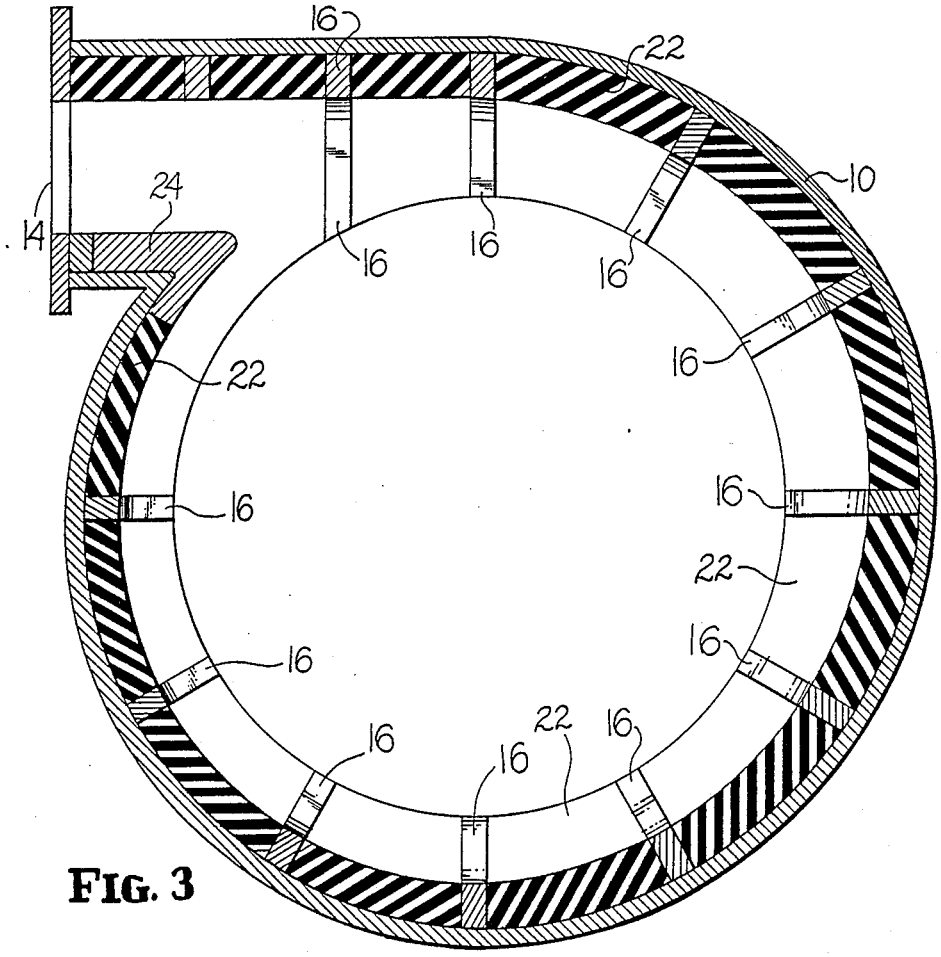
FIG. 3 is a sectional, side elevation of the pump of FIG. 1 showing the alternating arrangement of hard and soft liner sections.
Figure 4:
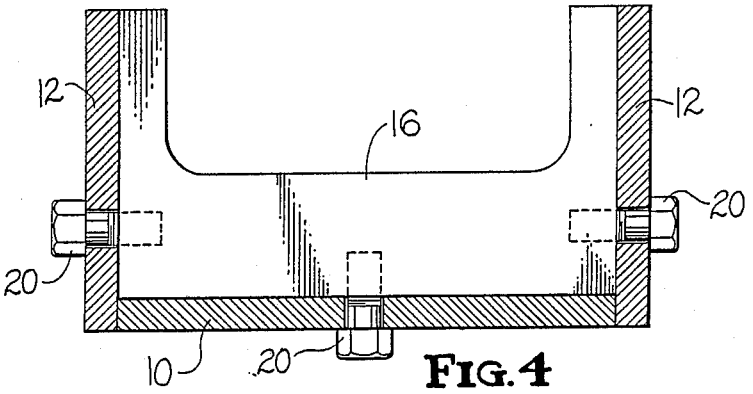
FIG. 4 is an end view of a "hard" rib member of the abrasion-resistant liner of this invention, the drawing illustrating an alternative mounting arrangement for the ribs on the pump housing.

As is seen best in FIGS. 1 and 3, both the hard rib members 16 and the soft material 22 of the liners are equal in thickness and configuration, and thereby provide a uniform, smooth inner surface encircling the pump impeller (not shown) when the liner is fully installed in the pump. Ideally, although not to be limited solely to, the desired thickness of the liner sections 16, 22 off of the housing wall surface is preferably at least one inch on smaller industrial pumps, and approximately 6 inches or more on large pumps.

Preferably, as illustrated in FIG. 3, there is provided a hard metal outlet corner member, cutwater 24, at the juncture of the pump volute and the discharge outlet 14. This member is preferably hard metal, as this portion of the pump is particularly susceptible to direct impact from solids being pumped.

Reference has been made throughout the disclosure to the hard and soft liner segments of this invention. It is now understood that the present invention provides a liner which comprises a plurality of alternating segments of material which vary in hardness and resiliency characterists one segment relative to its adjacent segments. Illustrative of desirable varying characteristics between liner segments, particularly wherein large pumps such as those used in dredging and hydraulic transport of solid materials for example, are hard liner segments of a material having a hardness of approximately 500 -650Brinnell, and soft segments formed of a material having a resiliency of approximately 40 -80durometer. Although these ranges are identified as desirable for the particular conditions encountered in these types of pump uses, it will be understood that other pump uses might require different combinations of segment material characteristics.

In the installation of the liner of this invention, a plurality of hard metal rib setments 16 are installed as illustrated in spaced apart condition circumferencially about the inner wall surface of the pump housing 10. The rib members may be welded in place, bolted in place, or otherwise attached in any suitable manner as indicated by the particular pump construction. When so installed, open spaces between adjacent hard metal rib members are thus formed.

"Soft" abrasion resistant material 22 is then installed, as shown, in the spaces formed between adjacent rib segments 16. This soft material is installed in conventional ways that are appropriate for the particular type of material being used. As an example, if rubber material is being installed, it may be vulcanized into position, whereby it becomes bonded strongly to the surface of the housing 10 and to the side walls 12 of the pump housing and also to the confronting edge surfaces 16' of each adjacent rib member 16 defining the space for the rubber material to occupy. Alternatively, preformed rubber, polymer or plastic sections could be cemented into tight fitting condition occupying the space between the ribs, molded into desired position, or attached by anchors into position. The resulting surface formed by the alternating sections of "hard" metal ribs and "soft" abrasion-resistant material provides a substantially smooth, even surface encircling the impeller of the pump. The resulting pump construction that is intended to be used is a smooth circumferencial surface in which alternating sections of hard metal and soft abrasion-resistant material form the entire surface area of the pump housing facing the outside circumferencial edge of the impeller.

In operation of a pump having the abrasion-resistant lining of this invention installed therein, solid-laden water is drawn through the inlet of the pump by the operation of the impeller, and the "hard" liner sections deflect the solid materials or other large sharp objects which are being spun around the inside of the casing by the impeller during the pumping process. The hard metal rib members 16 protect the "soft" liner sections from being cut and torn, while also themselves, by capturing the separate soft segments securely therebetween, minimize the occurrence of any bonding failure of the soft sections. Absent the "sandwich" construction utilizing the hard and soft combination of sections, it is known in the art that bonding failures are commonplace, and damage and subsequent destruction of an all "soft" liner material by sharp solid objects frequently occurs, requiring constant and ongoing down time, maintenance and repair. It is therefore recognized that it is this "sandwich" construction of alternating sections that affords the liner of this invention its particular desirability and utility.

Should a section of hard or soft material be damaged by impact or the like, repair to the liner may involve only the removal and replacement of the particular injured segments, rather than the entire liner itself or "patchwork" repair to the entire liner as has heretofore been required.

From the foregoing, it will be apparent to those skilled in the art that various changes other than those already described may be made in the size, shape, type, number and arrangement of parts described hereinbefore without departing from the spirit of this invention and the scope of the appended claims. For example, no reference has been made to the particular dimensions of the two liner sections, nor to any specific desired number of alternating sections for any given size of pump. These variables would be determined by the particular use of the particular pump and the environment to which it is going to be subjected.

Having thus described my invention and the manner in which it may be used, I claim:

1. An abrasion-resistant liner for a conventional centrifugal solids pump, the abrasion-resistant liner comprising:

(a) a plurality of hard liner segments configured for attachment to the inner, circumferential surface wall of a centrifugal solids pump housing in spaced apart condition about the inner circumferential surface thereof, forming open spaces between adjacent hard liner segments, and (b) a plurality of soft abrasion-resistant material liner segments configured for attachment to the inner, circumferential surface wall of a centrifugal solids pump housing in said open spaces formed between and isolated by said adjacent hard liner segments, (c) both said plurality of liner segments configured to form, when attached to the inner, circumferential surface wall of a centrifugal solids pump, an even, smooth inner surface of alternating hard and soft segments facing the outside edge of a conventional impeller of a centrifugal solids pump.

2. The abrasion-resistant liner of claim 1 wherein said hard liner segments are attached to a centrifugal solids pump housing by welding, and said soft liner segments comprise abrasion-resistant material bonded securely in position between said hard liner segments.

3. The abrasion-resistant liner of claim 1 wherein said hard liner segments are attached by means of screws to a centrifugal solids pump housing and said soft liner segments comprise abrasion-resistant material bonded securely into proper position between adjacent hard liner segments on the housing.

4. An abrasion-resistant centrifugal solids pumpshell assembly, comprising:

(a) a pump shell housing, (b) a plurality of hard liner segments secured within the housing at spaced apart locations about the inner circumferential wall of said housing, (c) a plurality of abrasion-resistant soft liner segments secured within the housing in the spaces formed between and isolated by said hard liner segments, the alternating hard and soft segments configured to form, when attached to said inner circumferential surface wall of a centrifugal solids pump housing, an even, smooth inner surface facing the confronting edge of a conventional impeller of the pump.

5. The assembly of claim 4 wherein the hard liner segments are metal, and are welded onto the housing in spaced apart condition circumferentially about the inner wall surface thereof and the soft, abrasion-resistant liner segments are bonded in place on the housing between adjacent said hard liner segments.

6. The assembly of claim 4 wherein the hard liner segments are attached to the pump housing by screw means, and the soft, abrasion-resistant liner segments are bonded by suitable means in position between adjacent hard liner segments.

7. The assembly of claim 4 wherein the abrasion resistant liner is repairable by each of the hard liner segments and the soft liner segments being replacable independently of one another.

* * * * *